United States Patent [19]

Henley et al.

[11] 4,311,884

[45] Jan. 19, 1982

[54] MINIATURE SEALED DUAL-IN-LINE SWITCH

[75] Inventors: Roger Henley, Upton; Blake W. Reynolds, Marblehead, both of Mass.

[73] Assignee: C & K Components, Inc., Newton, Mass.

[21] Appl. No.: 41,070

[22] Filed: May 21, 1979

[51] Int. Cl.[3] ..... H01H 19/00; H01H 21/00; H01H 23/00

[52] U.S. Cl. ..... 200/5 R; 200/6 R; 200/6 B; 200/16 R; 200/153 L; 200/153 LB; 200/164 R; 200/302; 200/303; 200/330; 200/339; 200/159 B

[58] Field of Search ..... 200/5 R, 5 H, 6 R, 6 A, 200/6 B, 6 BB, 6 BA, 6 C, 16 R, 16 C, 16 D, 153 L, 153 LB, 153 M, 159 A, 159 B, 164 R, 237–239, 243, 245–247, 302, 303, 315, 316, 321, 322, 329, 335, 336, 339

[56] References Cited

U.S. PATENT DOCUMENTS

| | | | |
|---|---|---|---|
| 3,219,784 | 11/1965 | Toruk et al. | 200/164 R X |
| 3,222,467 | 12/1965 | Meyer . | |
| 3,238,344 | 3/1966 | Miachon . | |
| 3,558,423 | 6/1971 | Hallerberg | 200/302 |
| 3,694,606 | 9/1972 | Otterlei | 200/16 C |
| 3,742,171 | 6/1973 | Howe | 200/67 C X |
| 3,883,705 | 5/1975 | Sebastian et al. | 200/6 B |
| 3,898,397 | 8/1975 | Devore et al. | 200/6 A |
| 3,900,709 | 8/1975 | Sheesley et al. | 200/6 B X |
| 3,941,953 | 3/1976 | Misson et al. | 200/5 A X |
| 3,965,319 | 6/1976 | Lockard . | |
| 3,996,428 | 12/1976 | Buan et al. | 200/302 X |
| 4,012,608 | 3/1977 | Lockard | 200/164 R X |
| 4,119,823 | 10/1978 | Matsueda et al. | 200/6 R X |
| 4,177,367 | 12/1979 | Tirone et al. | 200/159 A |
| 4,191,867 | 3/1980 | Feaster | 200/303 |

*Primary Examiner*—James R. Scott

*Attorney, Agent, or Firm*—Weingarten, Maxham & Schurgin

[57] ABSTRACT

A miniature switch assembly of dual-in-line configuration having a plurality of switching chambers, each of the switching chambers having at least a pair of terminal lands disposed therein. Each switching chamber is sealed by means of an electrically-insulative, elastic membrane and has an electrically-conductive contact within each chamber disposed closely adjacent the membrane. The contact is permitted to float within its respective chamber and is adapted to interconnect one of the pair of contact lands with the other of the pair of contact lands by means of an actuator which flexes the membrane from outside of the chamber without extending through the membrane. An actuator of a rocker-type is retained in either an OFF or an ON position by means of a bezel which engages a detent on the upper surface of the actuator. The membrane and contact together bias the actuator in a desired operative position. This structure may be applied to one's switch element, as well as many such elements in either a tandem or a unitary dual-in-line configuration.

38 Claims, 15 Drawing Figures

MINIATURE SEALED DUAL-IN-LINE SWITCH

FIELD OF THE INVENTION

This invention relates generally to switches and more particularly to miniature dual-in-line switches in which the terminal lands are sealed within a chamber by means of a flexible elastomeric membrane.

DISCUSSION OF THE PRIOR ART

A problem often encountered with sub-miniature, dual-in-line (DIL) switches for use in electrical components is contamination introduced by wave soldering and subsequent board cleaning operations. One attempted solution often employed is to cover the switches with boots, covers, tapes and the like which are not part of the switches themselves, these devices being removed from the switch once all the user's manufacturing processes are concluded.

Another possible solution is to employ switches that are internally environmentally sealed. In several of such switches, the switch actuator extends into the enclosed chamber, and a seal is effected by the use of a flexible membrane disposed around the switch actuator. Examples of such prior art switches are shown in U.S. Pat. Nos. 3,222,467 and 3,898,397. Other switches, such as that shown in U.S. Pat. No. 3,742,171, employ a shroud or other means for covering the switching chamber during all phases of operation. In each of the above-referenced switches, the switch actuator is in direct communication with the electrical contact within the switch. The seal in each of the above-referenced switches is not completely moisture-proof and is not fully effective to prevent the entry of dust or other pollutants into the switching chamber surrounding the contacts, and in many of them, the structure of the mechanism is too complex for use in sub-miniature electrical components.

There are other prior art switches in which the switch actuator is separated from the electrical contacts by a seal or membrane. In one variety of such switches, one of the contacts itself or a mechanism associated therewith provides the necessary biasing. Examples of these switches are shown by U.S. Pat. Nos. 3,558,423 and 3,996,428. In another variety of ON-OFF electrical contact structures, the necessary biasing is provided by the membrane or seal. An example of such device is shown in U.S. Pat. No. 3,694,606. The electrical contacts shown in U.S. Pat. Nos. 3,996,428 and 3,694,606 are provided with only a momentary ON position. In the devices of the latter two patents, one of the contacts is movable with respect to the other, and the two spaced contacts are electrically interconnected in the ON position only so long as pressure is externally applied to the membrane to urge the one contact against the other.

However, although many sealing means for switches have been available prior to this invention, generally they have had serious drawbacks in that either they are not able to withstand the harsh environments present during component assembly and still be suitable for use in sub-miniature electrical components, or their cost or assembly difficulties make their widespread use impractical.

SUMMARY OF THE INVENTION

This invention is generally concerned with an ON-OFF miniature switch of dual-in-line (DIL) configuration in which an actuator is sealingly separated from terminal lands by means of an elastomeric membrane. In one embodiment of the invention, each switching element of the DIL configuration has two electrical terminals mounted on a dielectric base and extending outwardly from the base and generally parallel to each other. Each one of the pair of electrical terminals has a land formed therein. The two terminal lands are enclosed by a sealed chamber created by shoulders formed in the base and an elastomeric membrane supported upon the shoulders in a confronting relationship with the terminal lands. A dimple or ridge projecting into the chamber forms a fulcrum which is disposed intermediate the two terminal lands. The ridge is preferably in fixed electrical connection with one of the terminal lands. Closely adjacent the underside of the membrane within the chamber is a floating electrical contact which is confined within the walls of the chamber and which is constantly stressed over the ridge and in constant electrical connection therewith.

A bezel is clamped onto the base, and the bezel has a surface disposed in spaced confronting relationship with the membrane. Captured between the surface and the membrane and associated with each switching element is a floating actuator which is adapted to be pivoted into at least two operating positions. Each actuator has a pair of projections, one disposed generally opposite each terminal land, and each projection is adapted to depress the membrane therebelow to provide force to maintain the contact in a stressed condition. To move each switching element to an ON position, the associated actuator is pivoted such that one of the projections depresses the membrane and the contact above the other of the terminal lands and thereby electrically connects the contact with the other of the terminal lands to provide an electrical connection between the two terminal lands. The associated actuator and the contact are retained in an ON position by means formed on the bezel adapted to cooperatively engage a detent on the actuator. The membrane and contact together act to bias the actuator detent against the bezel means to ensure engagement therewith. The actuator may also be retained in an operative position by the provision of shoulders on the actuator which mate with and are engaged by shoulders on the bezel housing. Each switching element may be placed in an OFF position by depressing the associated actuator above the one terminal land to thereby pivot the actuator so that the one projection no longer depresses the membrane above the other terminal land. The contact then springs out of connection with the other of the terminal lands. Upon release of pressure from the actuator, the membrane returns to its original position and the contact and membrane act to bias the detent against the bezel means so as to retain the actuator in the OFF position.

Because the actuator does not extend into the chamber containing the terminal lands and contact strip, and because upon stretching of the elastomeric membrane the actuator projection does not extend therethrough, no dust, dirt or other pollutants are permitted into the chamber. This feature permits installation of the switch during the assembly of the other electrical components, and it permits spray or immersion cleaning after wave soldering without the possibility of causing contamination which could result in malfunctioning of the switch. Since the elastomeric membrane serves to bias the switch as well as to seal the chamber, the construction of the switch is greatly simplified and the switch may be inexpensively constructed in sub-miniature sizes. In other configurations, the actuator could be a slide, pushbutton, lever or toggle mechanism, as well as the rocker mechanism described above.

BRIEF DESCRIPTION OF THE DRAWINGS

The objects, advantages and features of this invention will be more clearly appreciated from the following detailed description when taken in conjunction with the accompanying drawing in which.

DETAILED DESCRIPTION OF THE PREFERRED EMBODIMENT

Figure 1:
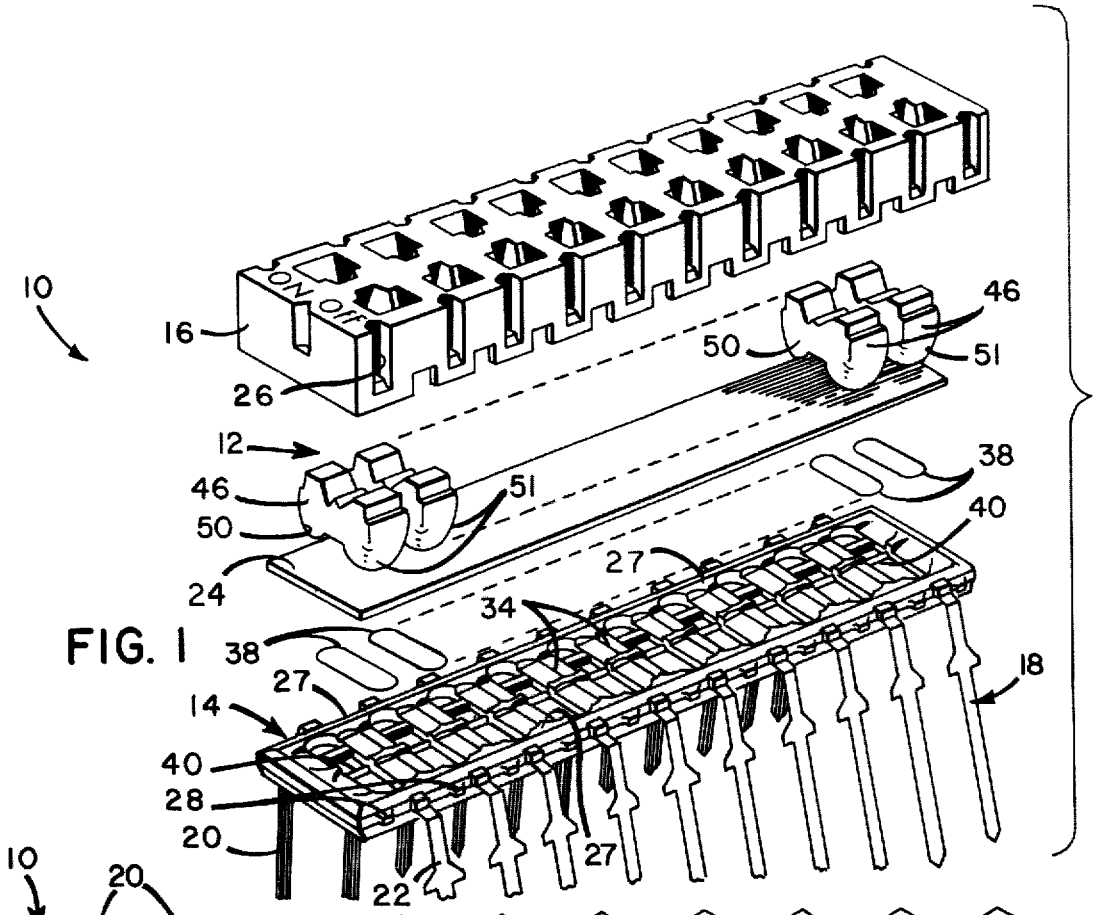
FIG. 1 is an exploded perspective view of the switch assembly of the invention.
Figure 2:
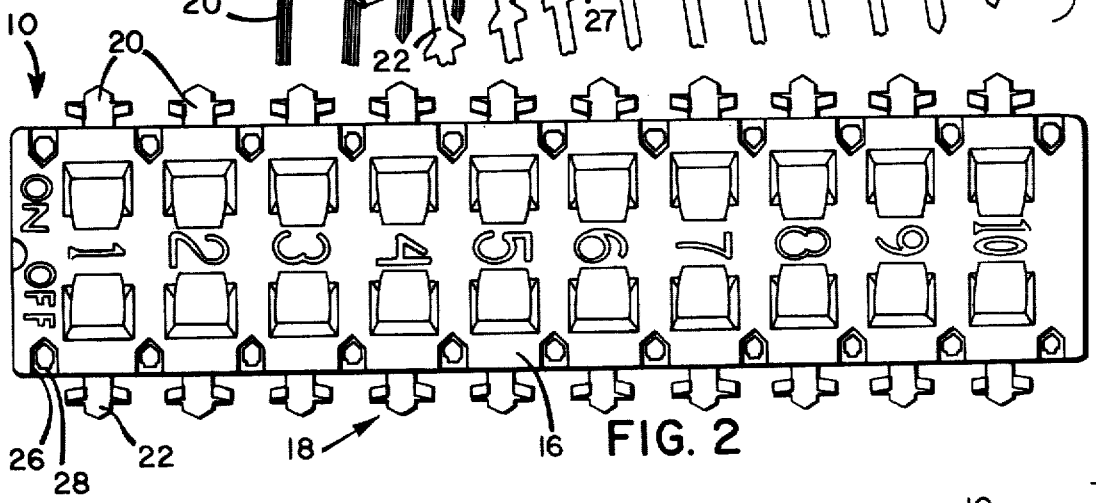
FIG. 2 is a top view of the assembly of FIG. 1.
Figure 3:
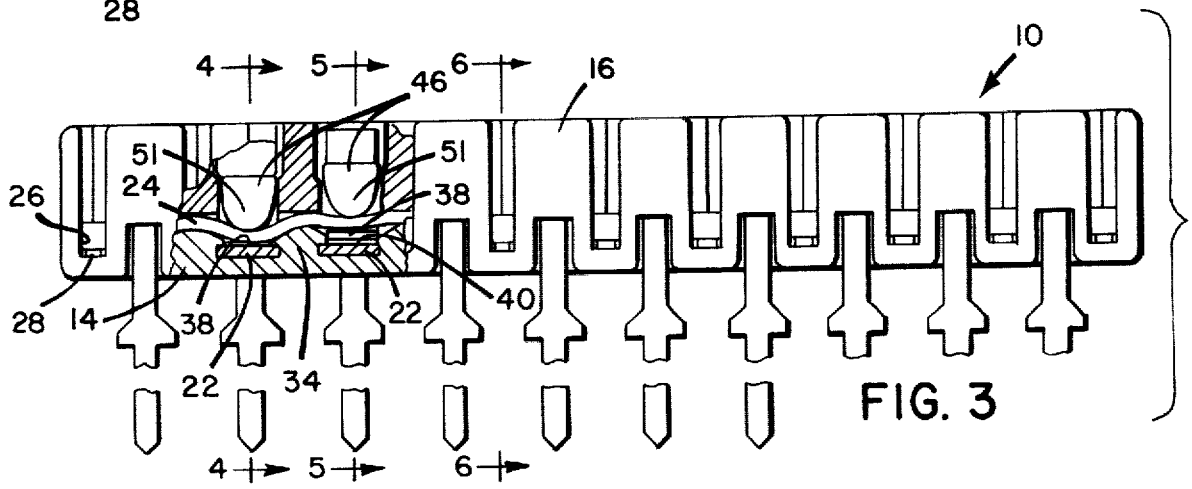
FIG. 3 is a side view of the assembly of FIG. 1.

With reference now to the drawing and more particularly to FIGS. 1, 2 and 3 thereof, there is shown a multiple switch assembly 10 having a plurality of individual elements 12 mounted in a base 14. Extending from the base 14 is a plurality of terminals 18 arranged in pairs, each pair of terminals 18 being associated with an element 12 and having a first terminal 20 and a second terminal 22. A bezel 16 having slotted legs 26 is adapted to be snapped onto the base 14 so that slotted legs 26 engage projections 28 on the base to securely attach the bezel thereto.

Figure 4:
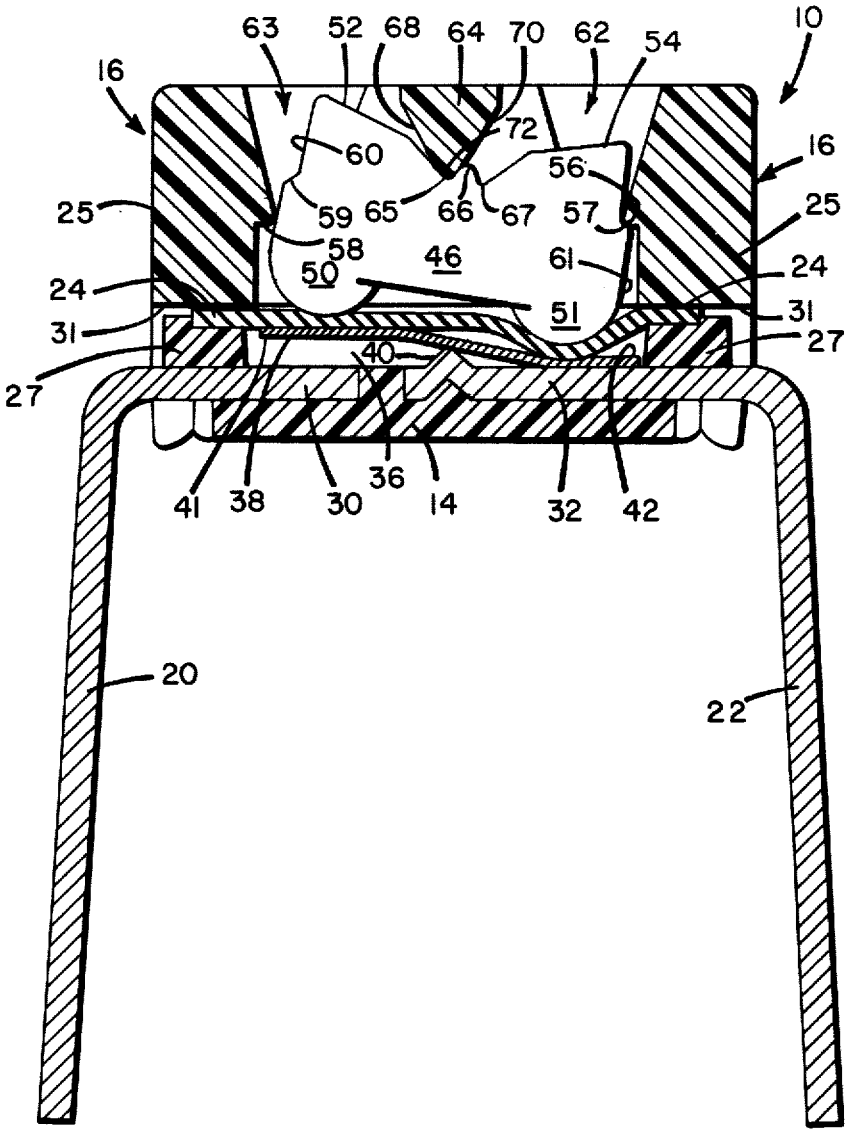
FIG. 4 is a cross-sectional view along line 4—4 of the embodiment of FIG. 3 in one operative position.
Figure 5:
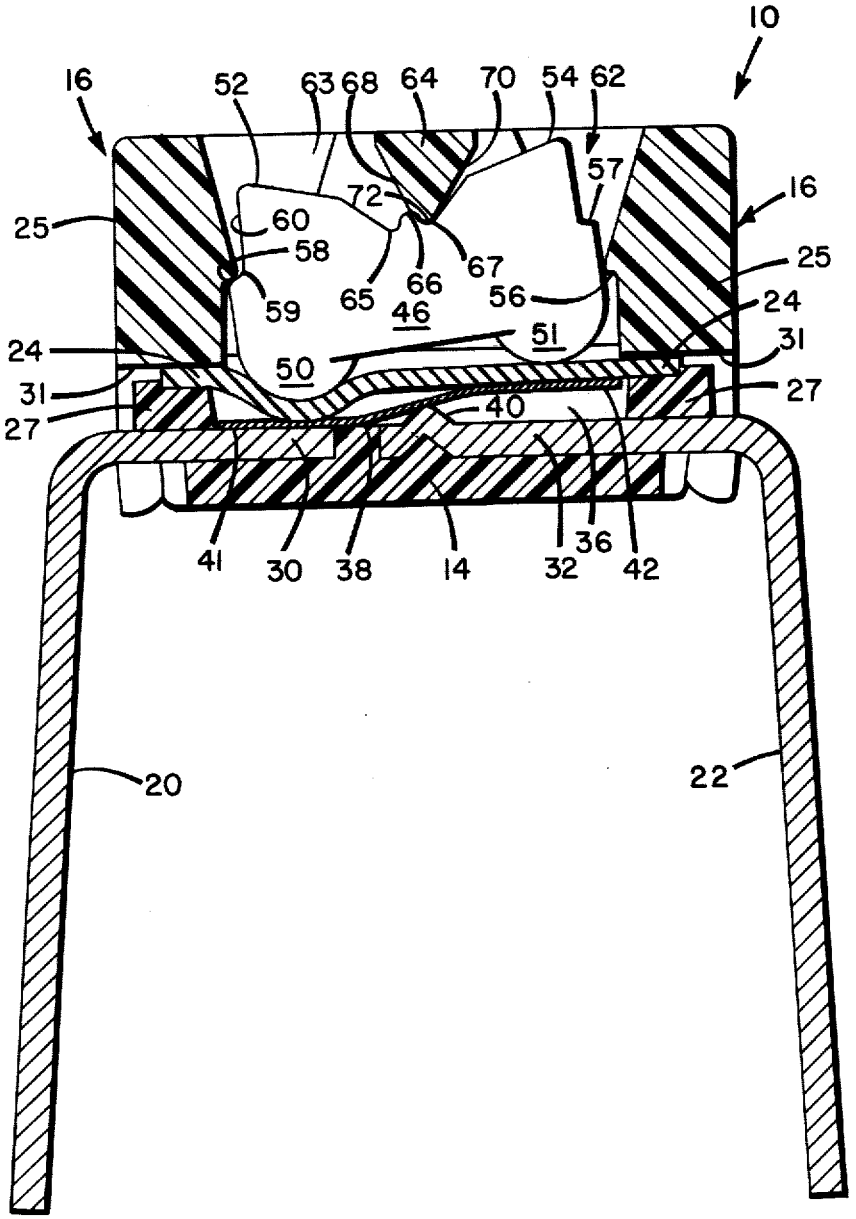
FIG. 5 is a cross-sectional view along line 5—5 of the embodiment of FIG. 3 in a second operative position.
Figure 6:
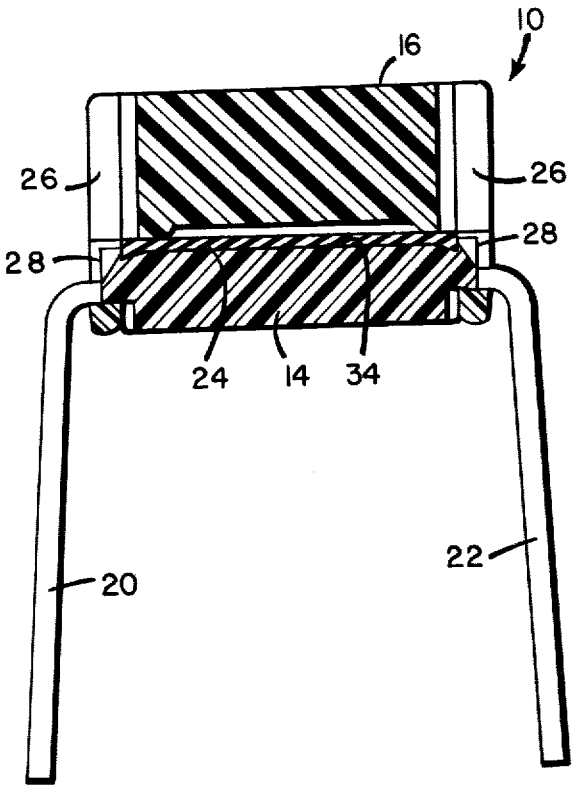
FIG. 6 is a cross-sectional view along line 6—6 of the embodiment of FIG. 3.

As shown in FIGS. 4 and 5, the switch terminals 20 and 22 of each pair of terminals are respectively formed with electrically associated contact lands 30 and 32. Raised surfaces 34 formed on base 14 (FIG. 1) are disposed between each pair of terminals 20, 22 to electrically insulate contact lands 30, 32 from similar adjacent pairs of contact lands. Contact lands 30, 32 are preferably below the level of raised surfaces 34. Land 32 is formed with an upwardly projecting fulcrum or ridge 40 disposed on an end thereof intermediate terminals 20 and 22. Membrane 24 rests on raised surfaces 34 in spaced facing relationship with respect to lands 30, 32. The membrane is tightly sealed along peripheral shoulders 27 on base 14 by wall 25 on bezel 16. Thus, assembly 10 and each pair of lands 30 and 32 is environmentally sealed. Within each chamber 36 is disposed an elongated floating contact 38 closely adjacent the underside of membrane 24. Contact 38 rests on ridge 40, is pivotable thereabout and is urged by ridge 40 upwardly against membrane 24. Contact 38 is maintained thereby in a constantly stressed condition. Actuator 46 rests on membrane 24 and is pivotable into a plurality of operating positions. A pair of rounded projections 50 and 51 are symmetrically located on opposite ends of the underside of actuator 46 and are adapted to engage flexible membrane 24 and to depress the corresponding one of either end 41 or end 42 of contact 38 downwardly into respective electrical connection with either land 30 or 32 when actuator 46 is pivoted in either a counterclockwise direction or a clockwise direction, respectively, as shown in FIG. 5.

When actuator 46 is pivoted in a counterclockwise direction, land 30 is in bridging electrical connection with ridge 40 on land 32 as contact 38 is depressed onto land 30, and the switch 12 is in an ON operative position, as shown in FIG. 5. When actuator 46 is subsequently pivoted in a clockwise direction, contact 38 is disconnected from land 30 as the inherent upward bias in contact 38 causes it to lift off land 30 and pivot about ridge 40 when projection 50 disengages from membrane 24. The switch 12 is then in an OFF operative position. At the same time, the elasticity inherent in membrane 24 causes it to rise to the position shown in FIG. 4. Further pivoting of actuator 46 causes projection 51 to depress membrane 24 adjacent land 32 and to bring contact 38 into connection therewith. As shown in FIG. 4, end 54 of the actuator is adapted to be engaged by a downward external force acting through slot 62 in the bezel to pivot the actuator in a clockwise direction, while end 52 of the actuator is adapted to be engaged by a downward external force acting through slot 63 in the bezel to pivot the actuator in a counterclockwise direction.

Projecting shoulder 56 formed on wall 25 of bezel 16 cooperates with surface 61 on the actuator to restrict clockwise pivoting of actuator 46 to within certain predetermined limits. Shoulder 56 is engageable by mating shoulder 57 formed on surface 61 to assist in retaining actuator 46 in an OFF operating position. Similarly, shoulder 58 on the other side of the bezel cooperates with surface 60 to restrict counterclockwise rotation of actuator 46, and shoulder 58 is engageable by mating shoulder 59 formed on surface 60 to assist in retaining actuator 46 in an ON operating position. Shoulders 56, 58, 57 and 59 may be modified as shown by shoulders 56*a*(FIG. 8), 58*a*, 57*a* and 59*a* which assist in retaining actuator 46 in a desired operating position in a manner similar to that of shoulders 56, 58, 57 and 59.

Actuator 46 is formed with protruding detent 66 which normally engages a mating projection 64 extending downwardly from bezel 16. Detent 66 and projection 64 assist in retaining actuator 46 in either an ON position or in an OFF position.

Contact 38 in its stressed condition possesses an upward spring bias, while membrane 24 is formed of an elastic material. Contact 38 and, to a certain extent, membrane 24 serve to positively bias the actuator in an upward direction so that detent 66 is continuously urged into contact with projection 64 on the bezel. This bias causes one of the surfaces of projection 64 in turn to press downwardly against detent 66 to prevent actuator 46 from accidentally pivoting out of the selected operative position. When actuator 46 is in an OFF operative position, detent 66 is in engagement with surface 70 of projection 64, and point 72 of projection 64 resides in groove 65 adjacent detent 66.

Membrane 24 may also be formed of a compressible material, and when the actuator is captured between the membrane and the bezel, the membrane is compressed. This membrane compression contributes to the positive upward bias applied to the actuator.

In operation, when a force is applied through slot 63 to actuator end 52 to pivot actuator 46 into an ON operative position, membrane 24 is deformed downwardly somewhat by projections 50 and 51, thereby permitting actuator 46 to move in a downward direction with respect to projection 64. The force on end 52 causes detent 66 to ride downwardly along surface 70 to point 72. When the tip of detent 66 reaches point 72 of projection 64, projection 50 still has not depressed membrane 24 sufficiently to cause contact 38 to connect with land 30, and contact 38 still is connected to land 32. However, once actuator 46 rotates sufficiently with the continued application of force to end 52 to cause the tip of detent 66 to move past point 72, the upward bias applied to actuator 46 by membrane 24 and contact 38 causes detent 66 to rapidly ride up along surfaces 68, in sliding engagement therewith until projection 64 resides in groove 67 and membrane 24 returns to its original condition, as shown in FIG. 5. At the same time, actuator 46 pivots quickly, causing contact 38 to snap firmly into connection with land 30 and out of connection with land 32. When a force is applied to actuator end 54 through slot 62 to pivot actuator 46 in a clockwise direction and into an OFF operative position, detent 66 rides downwardly along surface 68 to point 72. At this stage, contact 38 still is touching land 30 and is not touching land 32. As detent 66 rotates past point 72, contact 38 again snaps firmly into connection with land 32 and out of connection with land 30. Detent 66 then rapidly rides up along surface 70, in sliding engagement therewith until projection 64 resides in groove 65 and membrane 24 has returned to the original condition shown in FIG. 4.

Bezel 16 serves to capture actuator 46 between it and membrane 24 and to prevent actuator 46 from moving with respect to membrane 24. Actuator 46 is preferably not attached in any way to membrane 24, to shoulders 34 or to bezel 16.

Each actuator 46 in assembly 10 is independently actuated by the application of a force to end 52 through slot 63 or to end 54 through slot 62. Each set of lands 30 and 32 contained within chamber 36 is insulated from any other set of lands 30, 32 by shoulders 34. For sealing purposes, the base may be formed with the terminals 18 in place. In the preferred configuration shown in FIGS. 1 and 2, a single sheet of elastomer serves as membrane 24 for all of the chambers 36.

It should be noted that the configuration disclosed herein greatly simplifies the switch mechanism and allows for miniaturization and for ease and economy of construction. The membrane 24, as described above, serves several purposes, some of them being as a seal for chamber 36, as a support for actuator 46 and as a biasing means for detent 66. Furthermore, membrane 24 is essential in retaining contact 38 in place and stressing it by pinning contact 38 against ridge 40. It should be noted that contact 38 also assists in biasing detent 66 against projection 64. Since contacts 30 and 32 are sealed within chamber 36, assembly 10 may be sprayed or immersion-cleaned after wave-soldering to a desired structure such as an electrical panel board. Also, since projections 50 and 51 do not extend through membrane 24, chamber 36 remains environmentally sealed.

Figure 13A:
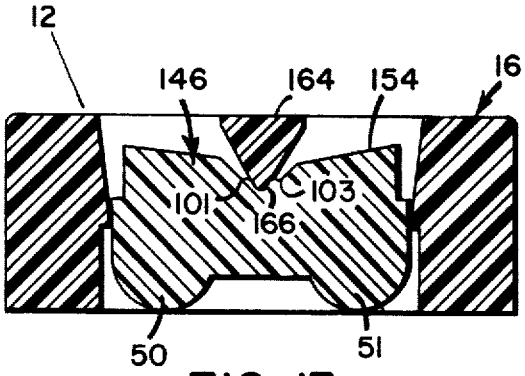
FIG. 13*a* is a cross-sectional view of another embodiment of the switch of FIG. 4 having three operative positions shown in the center "OFF" position.
Figure 13B:
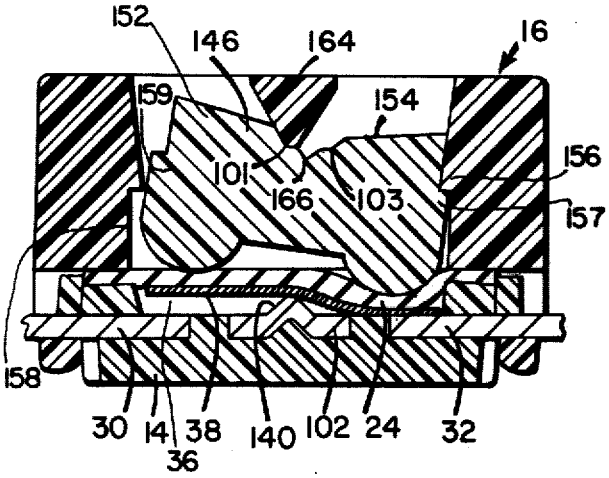
FIG. 13*b* is a cross-sectional view of another embodiment of the switch of FIG. 4 having three operative positions shown in the extreme "ON" position.
Figure 14:
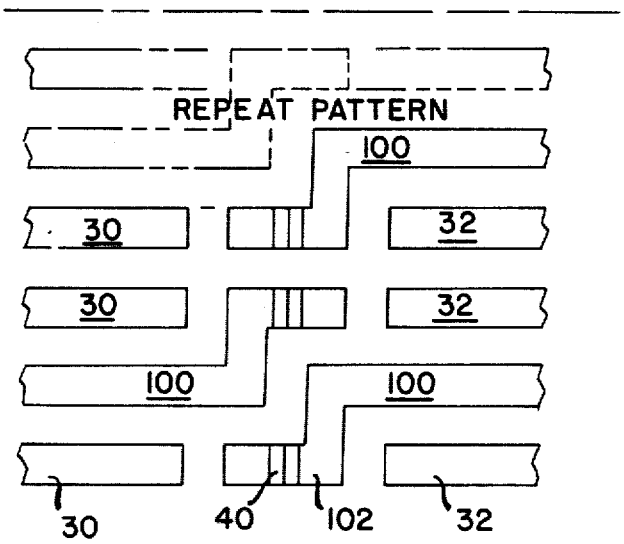
FIG. 14 is a schematic top view of a three-position, three-pole switch contact pattern for use in the invention.

The switch described above can be easily modified to have three operative positions as shown in FIGS. 13*a* and 13*b* in which like numerals are used for like parts where possible. A third terminal 100 is affixed to base 14 and has an electrically associated terminal land 102 disposed generally between lands 30 and 32 within chamber 36. Terminal 100 preferably extends substantially along base 14 transversely of chamber 36 and terminals 30 and 32 before projecting outwardly from base 14. In an assembly 10 in which each switch 12 has three operative positions, terminals 30, 32 and 100 would be arranged so that they extend from base 14 in the pattern shown in FIG. 14 in which terminal 100 is located on alternate sides of base 14 for each switch 12. Land 102 has ridge 140 formed thereon and ridge 140 projects upwardly into chamber 36 and into continuous electricaL connection with contact 38. Projection 164 extends downwardly from bezel 16, while actuator 146 has three cooperating detent notches 101, 103 and 166. Contact land 32 no longer has a ridge but is flush with the bottom of chamber 36. Contact 38 is supported in a spaced relationship with respect to lands 30 and 32 by ridge 140 which pins contact 38 against membrane 24, as in the previous embodiment of FIGS. 1–6. When actuator 146 is rotated in a clockwise direction by the application of a force to end 154, projection 51 depresses membrane 24, thereby producing a bridging electrical connection between contact lands 102 and 32, and projection 164 slides into notch 101 while shoulder 157 engages shoulder 156. When a force is applied to end 152 to rotate actuator 146 in a counterclockwise direction, projection 164 slides into notch 103 and contact 38 is in electrical connection only with land 102. Membrane 24 functions as described in the previous embodiments of this invention. When pressure is again applied to end 152, actuator 146 rotates further so that projection 164 moves into notch 166 and shoulder 159 engages shoulder 158. Projection 50 then depresses membrane 24, as described above, thereby producing bridging electrical connection between contact portions 30 and 102. When projection 164 is in notch 103, the switch is in an OFF position. When bridging electrical connection is made between the lands 30 and 102, the switch is in a first ON position, and when bridging electrical connection is made between lands 102 and 32, the switch is in a second ON position. In all other respects, the embodiment of FIG. 13 operates in a manner similar to that of FIGS. 1–6.

Figure 7:
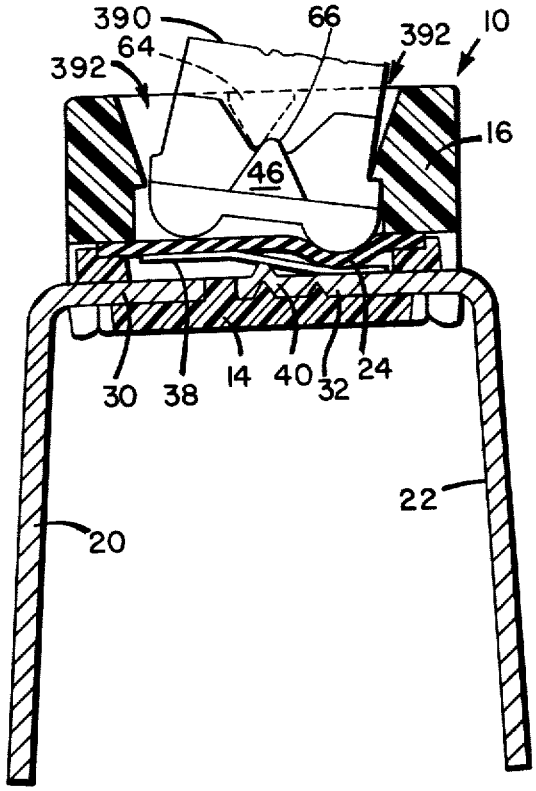
FIG. 7 is a cross-sectional view of another embodiment of the switch of FIG. 4 in the form of a two-position toggle switch.
Figure 8:
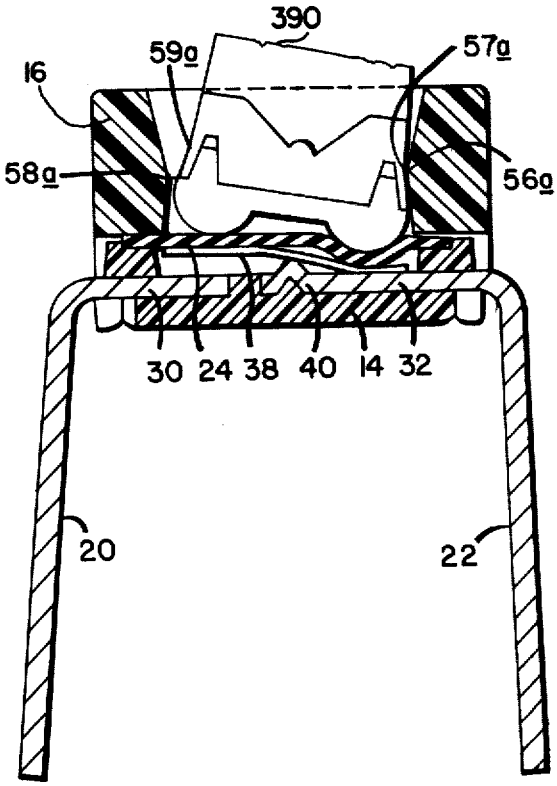
FIG. 8 is a cross-sectional view of another embodiment of the switch of FIG. 7 without a detent.

The switch of FIGS. 1–6 may additionally be modified for use with a toggle mechanism shown in FIG. 7. Like numerals are used for like parts were possible. A toggle 390 projects through slot 392 centered in bezel 16 between projections 64 extending downwardly from the upper surface of bezel 16. Toggle 390 is secured to detent 66 at approximately the transverse center thereof. Actuator 46 may be pivoted by the application of external force to toggle 390. Slots 62 and 63 are absent from this embodiment, and bezel 16 completely encloses ends 52 and 54 of actuator 46. Projection 64 does not extend transversely across bezel 16 as it does in FIGS. 1–6, but rather is present only on either side of slot 392. Furthermore, detent 66 is present on actuator 46 only on either side of toggle 390 and extends transversely to the same extent as projection 64. In all other respects, the operation of the embodiment of FIG. 7 is identical to that of FIGS. 1–6. The switch of FIG. 7 may be modified as shown in FIG. 8. Shoulders 56, 57, 58 and 59 of FIG. 7 are replaced by respective shoulders **56*a*, 57*a*, 58*a* and 59*a* of FIG. 8. Shoulders 56*a* and 58*a* are formed on portions of bezel 16 extending inwardly toward toggle 390. Shoulders 57*a* and 59*a* are formed on surfaces of toggle 390 and are adapted to conform to the shape of respective facing shoulders 56*a* and 58*a* by providing a recess to accommodate shoulders 56*a* and 58*a* respectively. When toggle 390 is pivoted to the right, as shown in FIG. 8, shoulder 56*a* engages mating shoulder 57*a* to alone retain toggle 390 in that operative position. Similarly, when toggle 390 is pivoted to the left in FIG. 8, shoulder 58*a* engages shoulder 59*a* to alone retain toggle 390 in that operative position. No bezel projection or detent is provided to assist shoulders 56*a*, 57*a*, 58*a* and 59*a*** in their retaining functions.

Figure 9:
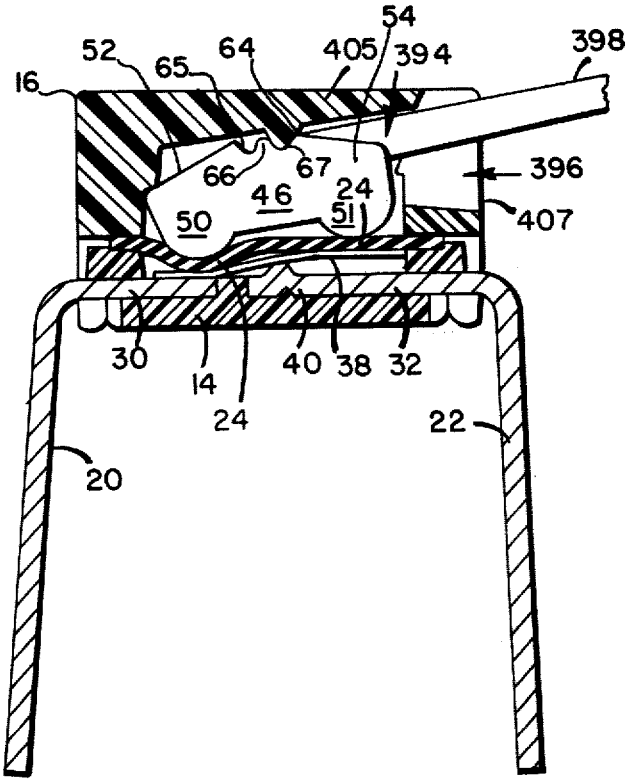
FIG. 9 is a cross-sectional view of another embodiment of the switch of FIG. 4 having a lever-type actuator.

The switch of FIGS. 1–6 may also be modified for use with a lever or "piano key" actuating mechanism as shown in FIG. 9, in which like parts have been assigned like numbers. A lever or "piano key" extends through opening 396 in the side of bezel 16 from one side of actuator 46. Actuator 46 is pivotable into one of a plurality of operating positions by the application of external force to end 398 of lever 394. In FIG. 9, actuator 46 may be pivoted into an ON position in which lands 30 and 32 are interconnected by the depression of membrane 24 adjacent land 30 by projection 50 or into an OFF position by the depression of membrane 24 adjacent land 32 by projection 51. Projection 64 extends laterally across the top of bezel 16 and is adapted to engage detent 66. Detent 66 has two parallel depressions 65 and 67, depression 67 being adapted to retain actuator 46 in an ON position and depression 65 being adapted to retain actuator 46 in an OFF position. Bezel 16 forms a solid enclosure around actuator 46, except for opening 396, and slots 62 and 63 are no longer present. Ends 52 and 54 have the tapered configurations shown in FIG. 9, rather than the upwardly extending surfaces shown in FIGS. 1–6. Lever 394 is restricted in its upward movement by surface 405 of bezel 16 and in its downward movement by surface 407 of bezel 16. In all other respects, the operation of the embodiment of FIG. 9 is identical to that of FIGS. 1–6.

Figure 12:
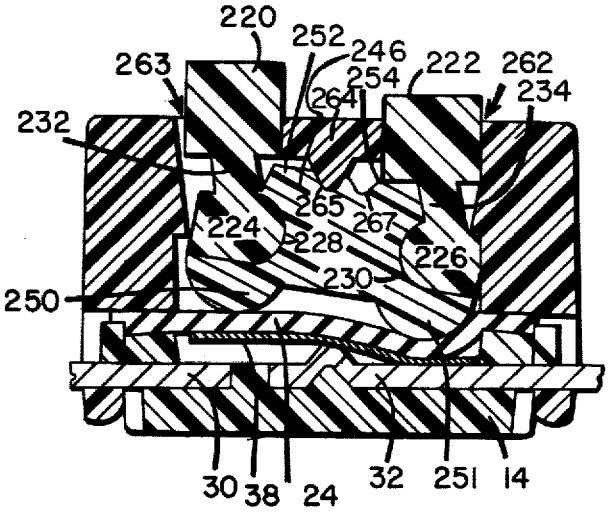
FIG. 12 is a cross-sectional view of another embodiment of the switch of FIG. 4 having a flexible pushbutton-type actuator.

The switch shown above in FIGS. 1–6 may also be modified for use with a pushbutton actuator, as shown in FIG. 12. The only differences in FIG. 12 are found in the actuator and the bezel. In all other respects, the switch of FIG. 12 is identical to that of FIGS. 1–6. Pushbuttons 220 and 222 extend through slots 263 and 262, respectively, in bezel 16. Pushbuttons 220 and 222 preferably have a round cross-section, but may be of any convenient shape. Pushbuttons 220 and 222 each are attached to respective rounded portions 224 and 226 which are captured within respective sockets 228 and 230 in actuator 246. Socket 228 overlies projection 250 while socket 230 overlies projection 251. Pushbutton 220 is connected to portion 224 by a flexible neck 232, while pushbutton 222 is connected to portion 226 by flexible neck 234. End surfaces 252 and 254 of actuator 246 are sloped upwardly away from necks 232 and 234 to allow the necks to oscillate to the left in FIG. 12 as pushbutton 222 is depressed and to the right as pushbutton 220 is depressed. Both portions 224 and 226 are pivotally mounted within their respective sockets to accommodate the up and down movement of the pushbuttons and the oscillation of the necks.

In operation, pushbutton 220 is depressed to interconnect lands 30 and 32 to place the switch in an ON position, while pushbutton 222 is depressed to pivot contact 38 out of connection with land 30 to place the switch in an OFF position. Actuator 246 snaps from one operative position to another as described for previous embodiments, and the extent of the pivotal motion of actuator 246 is limited by the respective engagement of necks 232 and 234 by end surfaces 252 and 254, and by the positioning of projection 264 in grooves 265 and 267.

Figure 10:
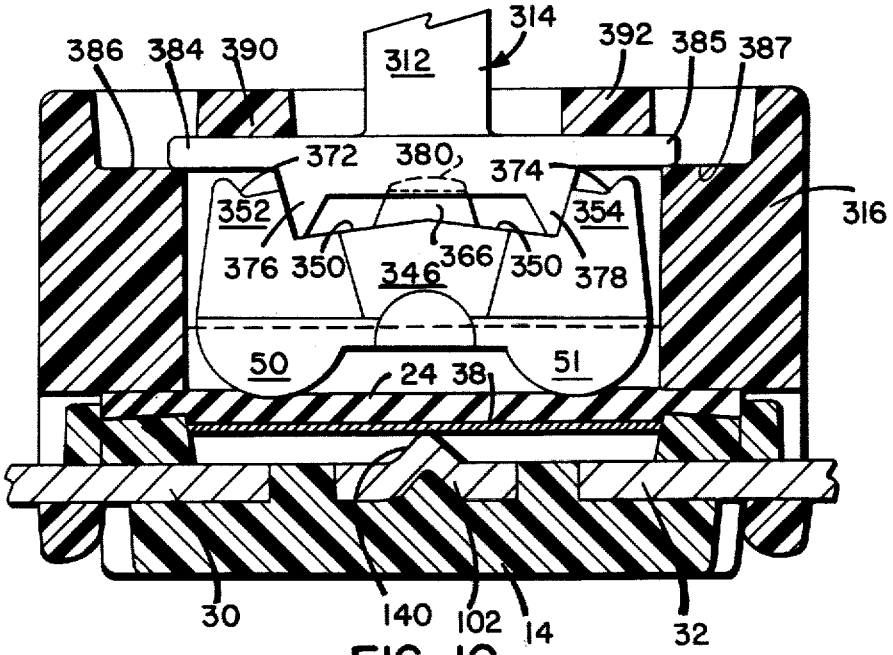
FIG. 10 is a cross-sectional view of another embodiment of the switch of FIG. 4 having three operative positions and a slide actuator shown in the "OFF" position.
Figure 11:
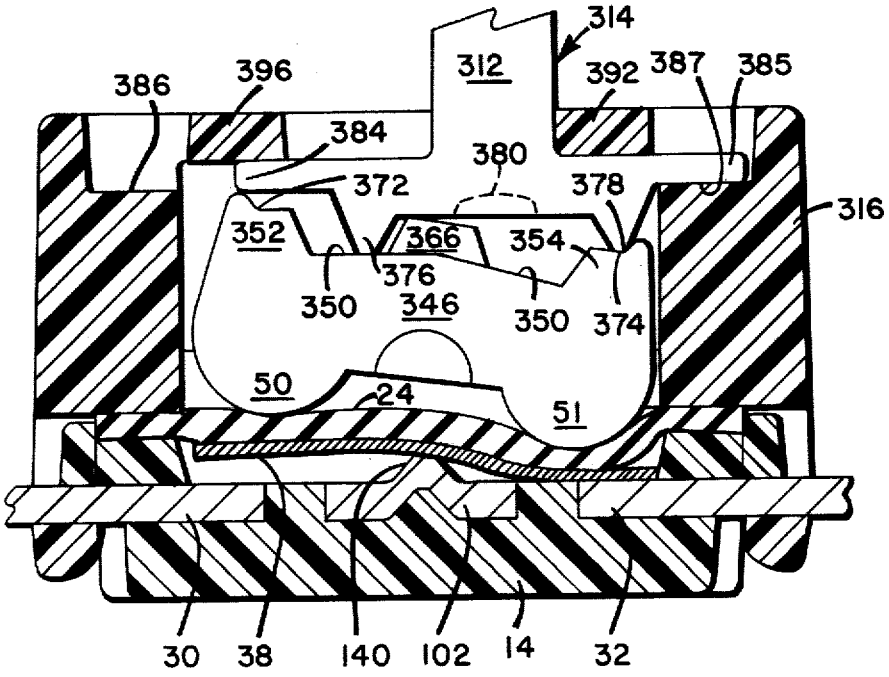
FIG. 11 is a cross-sectional view of another embodiment of the switch of FIG. 4 having three operative positions and a slide actuator shown in the "ON" position.

The switch of FIGS. 1–6 may also be modified for use with a slide actuator as shown in FIGS. 10 and 11. Bezel 316 has a slide 314 mounted onto the top thereof. Slide 314 has a handle portion 312 extending upwardly away from bezel 316 which is adapted to have force applied thereto for movement of slide 314. Slide 314 is urged in an upward direction by actuator 346 which has an upward bias provided by membrane 24 and contact 38. Slide 314 is thus captured between actuator 346 and overlapping ribs 390 and 392 in bezel 316 which slidably abut lateral portions 384 and 385 of slide 314. Ribs 390 and 392 also limit the lateral movement of slide 314 by restricting the movement of handle portion 312. Bezel 316 has depressions 386 and 387 formed on either side thereof to accommodate lateral portions 384 and 385 which are adapted to ride on surfaces 382 thereof when slide 314 is moved to an extreme right or left position as shown in FIG. 10. Slide 314 has a depression 380 formed directly below handle portion 312 and projections 376 and 378 which are disposed symmetrically about depression 380.

Actuator 346 has a centrally disposed detent 366 and two raised end portions 352 and 354 in which are found two respective notches 372 and 374. Between detent 366 and end portions 352 and 354 are depressed relatively flat surfaces 350. In all other respects, actuator 346 is the same as actuator 46 in FIGS. 1–6, and contact 38 and membrane 24 are the same as previously described. The switch shown in FIGS. 10 and 11 has three operative positions, but it should be understood that the same concept can be applied to a two position switch. The lands 30, 32 and 102 and associated terminals 20, 22 and 100 are the same as in the embodiment of FIG. 13, including the provision of ridge 140 on land 102.

In operation, the slide 314 may be moved manually or by any other means for directing force thereto. When slide 314 is moved to the extreme right in FIG. 11, lateral portion 385 overlies depression 387 and projection 378 rides up to snap into notch 374 to drive actuator 346 downwardly over land 32 and thereby to pivot actuator 346 smartly in a clockwise direction. Land 32 is thus interconnected to land 102 in such a first ON operative position, as projection 51 depresses membrane 24, as previously described. When slide 314 is then moved to the left in FIG. 10, projection 378 snaps out of notch 374 and rides onto surface 350. At the same time, projection 376 slides laterally along surface 350 to the left in FIG. 10. As detent 366 becomes positioned directly under depression 380, detent 366 pops into depression 380 to retain slide 314 in that position until further lateral force is applied thereto. The effect of this movement is to allow contact 38 to snap out of connection with land 32 and to allow membrane 24 and contact 38 to pivot actuator 346 in a counterclockwise direction until contact 38 is touching only land 102. The switch is now in an OFF operative position.

Further lateral force applied to slide 314 to the left in FIG. 10 causes detent 366 to pop out of depression 380 and projection 376 to ride up and snap into notch 372, while projection 378 continues to slide along surface 350. This movement drives actuator 346 downwardly over land 30, causing actuator 346 to pivot further in a counterclockwise position and projection 50 to depress membrane 24 as previously described. Contact 38 is thus snapped into connection with land 30, creating an ON operative position in which lands 30 and 102 are interconnected. In all other respects, this switch operates in a manner similar to that in the previously described embodiments.

For reference purposes, examples of the dimensions of the switch shown in FIG. 1 of this invention are set forth. It is to be understood that by providing such examples, the scope of the invention is in no way limited. The bezel and base form a combination typically 0.15 inch (3.81 mm) high, and 0.25 inch (6.35 mm) from one side of the base to the other. An assembly consisting of seven separate chambers is typically 0.75 inch (19.05 mm) in length. The actuator is typically 0.2 inch (5.08 mm) across and 0.09 inch (2.29 mm) from the bearing member to the top of the detent. The depth of the chamber is typically 0.006 inch (0.15 mm) and the thickness of the membrane is typically 0.005 inch (0.13 mm). With respect to materials, the non-conductive membrane is typically an elastomer such as silicone rubber, which is both elastic and preferably compressible, and the contacts are typically beryillum copper. The bezel and base may be formed of any suitable rigid plastic material.

In view of the above description, it is likely that modifications and improvements will occur to those skilled in the art which are within the scope of this invention.

What is claimed is:

1. An electrical switch comprising:

a base at least partially formed of dielectric material, said base being formed with a plurality of spaced, insulated, raised surfaces defining at least one cavity between adjacent ones of said raised surfaces, said raised surfaces having shoulders formed thereon;

a plurality of spaced electrical terminals mounted to said base, each of said terminals having a land within said cavity and an end projecting outwardly from one side of said base;

an electrically insulative deformable membrane disposed in sealing engagement with said peripheral shoulders, said membrane being continuous and extending between said peripheral shoulders to form an environmental seal around said terminal lands, said membrane being disposed on said raised surfaces in a spaced confronting relationship with said terminal lands and forming a chamber surrounding said terminal lands within said cavity;

a unitary, elongated electrically conductive contact disposed closely adjacent said membrane within said chamber, said contact being normally in unsecured electrical connection with said land of one of said terminals in a first operative position;

means for normally maintaining said contact in confronting, spaced relationship with respect to said land of others of said terminals;

upper housing means disposed in spaced, confronting relationship with said membrane; and actuator means pivotally disposed outside of said chamber between said membrane and said upper housing means, said actuator means being operable upon the application of eccentric force in one direction to depress said membrane towards said land of one other of said plurality of terminals to urge an end of said contact into electrical connection with said land of said other of said plurality terminals to produce a bridging electrical connection between said one terminal and said other terminal in a second operative position; said actuator means being operable upon the application of an eccentric force in another direction to release said depressed portion of said membrane to permit said contact end to return to its normal first operative position.

2. The electrical switch as recited in claim 1 wherein said upper housing means comprises a bezel secured to said base and capturing said actuator means between said membrane and a surface of said bezel facing said membrane.

3. The electrical switch as recited in claim 2 further comprising a detent formed on said actuator means and a projection formed on said bezel, said detent and said projection acting cooperatively to retain said actuator means in a desired one of said first and second operative positions.

4. The electrical switch as recited in claim 3 wherein said bezel is secured to said base by means of slotted legs formed on said bezel adapted to hook cooperative projecting fingers formed on said base.

5. The electrical switch as recited in claim 4 wherein said contact is pivotally stressed about said normally maintaining means to provide an upward spring bias thereto.

6. The electrical switch as recited in claim 4 or 5 wherein said membrane is captured around the perimeter thereof between shoulders formed on said bezel and said peripheral shoulders formed on said base.

7. The electrical switch as recited in claim 4 wherein said membrane biases said actuator means away from said base and against said bezel surface to produce secure engagement of said slotted legs by said projecting fingers and to produce secure engagement of said detent by said projection.

8. The electrical switch as recited in claim 5 wherein said contact biases said actuator means away from said base and against said bezel surface to produce secure engagement of said slotted legs by said projecting fingers and to produce secure engagement of said detent by said projection.

9. The electrical switch as recited in claim 5 wherein said contact and said membrane together cooperatively bias said actuator means away from said base and against said bezel surface to produce secure engagement of said slotted legs by said projecting fingers and to produce secure engagement of said detent by said projection.

10. The electrical switch as recited in any one of claims 7, 8 or 9 wherein said normally maintaining means comprises a ridge in electrical connection with said land of said one of said terminals.

11. The electrical switch as recited in claim 10 wherein said contact is pinned between said ridge and said membrane.

12. The electrical switch as recited in claim 3 wherein said actuator means comprises a pair of projections extending downwardly therefrom towards said membrane, said projections being disposed generally symmetrically about said normally maintaining means, one of said projections being disposed opposite said end of said contact and the other of said projections being disposed opposite another end of said contact.

13. The electrical switch as recited in claim 12 wherein the application of eccentric force to said actuator means deforms said membrane in a downwardly direction toward said base to permit said detent to disengage from said projection so that said actuator means is permitted to pivot from one to another operative position.

14. The electrical switch as recited in claim 13 wherein upon the application of eccentric force in said one direction said actuator means pivots in said one direction to induce said one projection to depress said membrane opposite said land of said other terminal to urge said end of said contact into electrical connection with said land of said other terminal.

15. The electrical switch as recited in claim 14 wherein upon the application of eccentric force in said another direction, said actuator means pivots in said another direction to induce said other projection to depress said membrane opposite said land of said one terminal to urge a second end of said contact into electrical connection with said land of said one terminal.

16. The electrical switch as recited in claim 1 wherein said actuator means comprises a rocker member pivotable about an axis generally normal to said one direction and said another direction.

17. The electrical switch as recited in claim 12 wherein said actuator means further comprises:

a rocker member pivotally disposed on the surface of said membrane and having said pair of projections extending downwardly from opposite extremities thereof;

a first ledge formed on said bezel adjacent said other terminal land;

a cooperating first shoulder formed on said rocker member and being engageable by said first ledge, to restrict pivotal movement of said rocker member in said one direction to a predetermined amount and to assist in retaining said rocker member in said second operative position;

a second ledge formed on said bezel adjacent said one terminal land;

a cooperating second shoulder formed on said rocker member and being engageable by said first ledge to restrict pivotal movement of said rocker member in said other direction to a predetermined amount and to assist in retaining said rocker member in said first operative position;

a first actuator surface formed on said rocker member generally above said one projection facing said bezel surface and adapted to receive external force applied through a first opening in said bezel to pivot said rocker member in said one direction; and a second actuator surface formed on said rocker member generally above said one projection facing said bezel surface and adapted to receive external force applied through a second opening in said bezel to pivot said rocker member in said other direction.

18. The electrical switch as recited in claim 15 wherein said detent comprises, a first triangular-shaped projection on said rocker member between said first actuator surface and said second actuator surface and extending towards said bezel surface facing said membrane, said first projection having a point, a first engaging surface, a second engaging surface, and a depression formed on either ridge of said triangular-shaped projection and wherein said bezel projection comprises a second fixed triangular-shaped projection formed on said bezel surface facing said membrane and extending towards said first projection for engagement therewith, said second projection having a point, a first surface engageable by said first engaging surface to retain said rocker member in said second operative position, and a second surface engageable by said second engaging surface to retain said rocker member in said first operative position.

19. The electrical switch as recited in claim 17 wherein said plurality of electrical terminals comprises two terminals, and wherein normally maintaining means comprises a ridge in electrical connection with said one terminal land.

20. The electrical switch as recited in claim 17 wherein said plurality of electrical terminals comprises three terminals, including a third terminal having a third terminal land disposed intermediately of said one terminal land and said other terminal land.

21. The electrical switch as recited in claim 20 wherein said normally maintaining means comprises a ridge in electrical connection with a land of a third terminal disposed intermediate said one terminal land and said other terminal land.

22. The electrical switch as recited in claim 20 comprising three operative positions, a first operative position wherein said one terminal land is bridgingly electrically connected to said third terminal land, a second operative position wherein said other terminal land is bridgingly electrically connected to said third terminal land and a third operative position wherein only said third terminal land is connected to said contact.

23. The electrical switch as recited in claim 22 wherein said detent comprises two spaced projections forming three grooves therebetween, each of said grooves being adapted to accept said bezel projection when said switch is in one of said three operative positions.

24. The electrical switch as recited in claim 12 wherein said actuator means further comprises:

a rocker member pivotally disposed on the surface of said membrane and having said pair of projections extending downwardly from opposite extremities thereof;

a first ledge formed on said bezel adjacent said other terminal land;

a cooperating first shoulder formed on said rocker member and being engageable by said first ledge, to restrict pivotal movement of said rocker member in said one direction to a predetermined amount and to assist in retaining said rocker member in said second operative position;

a second ledge formed on said bezel adjacent said one terminal land;

a cooperating second shoulder formed on said rocker member and being engageable by said first ledge to restrict pivotal movement of said rocker member in said other direction to a predetermined amount and to assist in retaining said rocker member in said first operative position; and a toggle lever projecting from said rocker member upwardly through a slot in said bezel surface, said toggle lever being actuable upon the application of external lateral force to pivot said rocker member into one of said first or second operative positions.

25. The electrical switch as recited in claim 12 wherein said actuator means further comprises:

a rocker member pivotally disposed on the surface of said membrane and having said pair of projections extending downwardly from opposite extremities thereof;

a first ledge formed on said bezel adjacent said other terminal land;

a cooperating first shoulder formed on said rocker member and being engageable by said first ledge, to restrict pivotal movement of said rocker member in said one direction to a predetermined amount and to assist in retaining said rocker member in said second operative position;

a second ledge formed on said bezel adjacent said one terminal land;

a cooperating second shoulder formed on said rocker member and being engageable by said first ledge to restrict pivotal movement of said rocker member in said other direction to a predetermined amount and to assist in retaining said rocker member in said first operative position;

a lever extending from said rocker member in a direction substantially parallel to said base and through a slot in a side of said bezel generally above one of said peripheral shoulders and adapted to be raised upwardly toward said bezel by the application of external force thereto to pivot said rocker member in said one direction and to be depressed downwardly toward said base by the application of external force thereto to pivot said rocker member in said other direction;

a first surface formed on said bezel generally above said other projection and adapted to restrict movement of said lever in said one direction to a predetermined amount; and a second surface formed on said bezel generally above said other projection and adapted to restrict movement of said lever in said other direction to a predetermined amount.

26. The electrical switch as recited in claim 12 wherein said actuator means further comprises:

a rocker member pivotally disposed on the surfaces of said membrane and having said pair of projections extending downwardly from opposite extremities thereof and having a raised end portion disposed generally above each one of said projections and a notch formed in each raised end portion;

a slide means slidably mounted into said bezel surface and having fingers projecting therethrough into sliding engagement with said rocker member, and a handle projecting upwardly away from said bezel and adapted for the application of lateral force thereto, one of said fingers being adapted to slide into said notch above said first projection upon the application of external force to said handle in one direction to pivot said rocker member into said second operative position and another of said fingers being adapted to slide into said notch above said second projection upon the application of external force to said handle in another direction to pivot said rocker member into said first operative position.

27. The electrical switch as recited in claim 26 further comprising a notch in said slide means adapted to receive said detent formed on said actuator to retain said rocker member in a third operative position wherein said contact is electrically connected only to said normally maintaining means.

28. The electrical switch as recited in claim 12 wherein said actuator means further comprises:

a rocker member pivotally disposed on the surface of said membrane and having said pair of projections extending downwardly from opposite extremities thereof;

a first ledge formed on said bezel adjacent said other terminal land;

a cooperating first shoulder formed on said rocker member and being engageable by said first ledge, to restrict pivotal movement of said rocker member in said one direction to a predetermined amount and to assist in retaining said rocker member in said second operative position;

a second ledge formed on said bezel adjacent said one terminal land;

a cooperating second shoulder formed on said rocker member and being engageable by said first ledge to restrict pivotal movement of said rocker member in said other direction to a predetermined amount and to assist in retaining said rocker member in said first operative position;

a first actuator plunger disposed in a slot formed on said bezel surface generally above said one projection and having a surface adapted to receive a downwardly directed external force toward said base, a rounded portion pivotally secured to said rocker member and a flexible neck connecting said plunger surface to said rounded portion, said first plunger being adapted to pivot said rocker member in said one direction upon the application of external force thereto;

a second actuator plunger disposed in a slot formed on said bezel surface generally above said one projection and having a surface adapted to receive a downwardly directed external force toward said base, a rounded portion pivotally secured to said rocker member, and a flexible neck connecting said plunger surface to said rounded portion, said second plunger being adapted to pivot said rocker member in said other direction upon the application of external force thereto.

29. A miniature dual-in-line switch assembly comprising:

a base at least partially formed of dielectric material and having a longitudinal length and a transverse width, said length being greater than said width;

a plurality of pairs of electrical terminals spaced from one another a longitudinal distance, each of said pairs of electrical terminals being mounted in and projecting outwardly from said base, and each of said pairs of electrical terminals having a first terminal and a second terminal;

a plurality of first terminal lands, each of said first terminal lands being associated with a corresponding one of said first terminals, each of said first terminal lands having a ridge formed thereon and disposed intermediate said transverse width;

a plurality of second terminal lands, each of said second terminal lands being associated with a corresponding one of said second terminals, each of said second terminal lands being spaced from a corresponding one of said first terminal lands a transverse distance and forming a pair therewith;

a plurality of insulating raised surfaces, said raised surfaces being disposed longitudinally and extending transversely between an adjacent pair of said first and said second terminal lands and forming a cavity around each of said pair of first and second terminal lands;

shoulders formed on the periphery of said base;

an electrically insulative deformable membrane sealingly secured to said peripheral shoulders, said membrane being spaced from and in a confronting relationship with each of said pairs of said first and said second terminal lands and providing a chamber enclosing each of said pairs of said first and second terminal lands and an environmental seal around said plurality of pairs of terminals;

a plurality of electrically conductive contacts, each of said contacts being disposed in a floating condition closely adjacent said insulative membrane within a one of said chambers and being pinned against said membrane by said ridge in fixed electrical contact therewith within said one of said chambers and being spaced from said second terminal land within said one of said chambers, each of said contacts being provided with a bias directed upwardly against said membrane;

a bezel securely affixed to said base in a confronting spaced relationship with said membrane, said bezel having a detent disposed generally intermediate said transverse width above each of said chambers on a surface of said bezel facing said membrane;

a plurality of actuators, one actuator being associated with each of said chambers, each of said actuators having a first and second projection formed thereon and being captured between said facing surface of said bezel and said membrane, each of said actuators being pivotable in one direction to permit a first projection to engage and depress said membrane at a point opposite said second terminal land to urge said contact into a second operative position wherein said contact is in bridging electrical connection with said second contact portion and each of said actuators being pivotable in another direction to permit disengagement of said membrane by said first projection and to allow said contact to return to a first operative position wherein said contact is not in connection with said second contact portion;

a projection formed on each of said actuators and being adapted to engage said detent to retain a corresponding actuator in a desired operative position;

projecting fingers formed on said base; and slotted legs extending toward said base from said bezel facing surface and adapted to engage said projecting fingers to secure said bezel to said base;

said membrane and said plurality of contacts together being operable to urge each associated actuator upwardly against said bezel facing surface to urge said projection into secure engagement with mating surfaces of said detent, and to urge said slotted legs tightly against said projecting fingers.

30. An electrical switch comprising:

a base at least partially formed of dielectric material, said base being formed with a plurality of spaced, insulated, raised surfaces defining at least one cavity between adjacent ones of said raised surfaces, said raised surfaces having shoulders formed thereon;

a plurality of spaced electrical terminals mounted to said base, each of said terminals having a land within said cavity and an end projecting outwardly from one side of said base;

an electrically insulative deformable membrane disposed in sealing engagement with said peripheral shoulders to form an environmental seal around said terminal lands, said membrane being disposed on said raised surfaces in a spaced, confronting relationship with said terminal lands to form a chamber surrounding said terminal lands within said cavity;

an elongated, electrically conductive contact disposed closely adjacent said membrane within said chamber, said contact being normally in electrical connection with said land of one of said terminals in a first operative position;

means for normally maintaining said contact in confronting, spaced relationship with respect to said land of others of said terminals;

a bezel secured to said base and having a surface disposed in a spaced, confronting relationship with said membrane;

actuator means captured between said bezel surface and said membrane outside of said chamber, said actuator means being pivotable upon the application of eccentric force in one direction to depress said membrane toward said land of one other of said terminals to urge an end of said contact into electrical connection with said land of said other terminal to produce a bridging electrical connection between said one terminal and said other terminal in a second operative position, said actuator means being pivotable upon the application of an eccentric force in another direction to release said depressed portion of said membrane and to permit said contact end to return to its normal first operative position;

a detent formed on said actuator means; and a projection formed on said bezel, said detent and said bezel projection acting cooperatively to retain said actuator means in a desired one of said first and said second operative positions.

31. The electrical switch as recited in claim 30 wherein said bezel is secured to said base by means of slotted legs formed on said bezel adapted to hook cooperative projecting fingers formed on said base.

32. The electrical switch as recited in claim 31 wherein said contact is pivotally stressed about said normally maintaining means to provide an upward spring bias thereto.

33. The electrical switch as recited in claim 31 or 32 wherein said membrane is captured around the perimeter thereof between peripheral shoulders formed on said bezel and said shoulders formed on said base.

34. The electrical switch as recited in claim 32 wherein said membrane biases said actuator means away from said base and against said bezel surface to produce secure engagement of said slotted legs by said projecting fingers and to produce secure engagement of said detent by said bezel projection.

35. The electrical switch as recited in claim 32 wherein said contact biases said actuator means away from said base and against said bezel surface to produce secure engagement of said slotted legs by said projecting fingers and to produce secure engagement of said detent by said bezel projection.

36. The electrical switch as recited in claim 32 wherein said contact and said membrane together cooperatively bias said actuator means away from said base and against said bezel surface to produce secure engagement of said slotted legs by said projecting fingers and to produce secure engagement of said detent by said bezel projection.

37. The electrical switch as recited in any one of claims 34, 35 or 36 wherein said normally maintaining means comprises a ridge in electrical connection with said land of said one of said terminals.

38. The electrical switch as recited in claim 37 wherein said contact is pinned between said ridge and said membrane.

* * * * *